219-121 SR
8/17/82 XR 4,344,839

United States Patent [19]

Pachkowski et al.

[11] 4,344,839

[45] Aug. 17, 1982

[54] PROCESS FOR SEPARATING OIL FROM A NATURALLY OCCURRING MIXTURE

[76] Inventors: Michael M. Pachkowski, 23141 - 72nd Ave., Langley, British Columbia; Howard V. Ross, 620 Montreal Trust Bldg., 789 W. Pender St., Vancouver, British Columbia, both of Canada

[21] Appl. No.: 166,052

[22] Filed: Jul. 7, 1980

[51] Int. Cl.³ ..... C10G 1/00; H05H 1/42

[52] U.S. Cl. ..... 208/11 R; 196/121; 219/121 P; 299/7; 315/111.21

[58] Field of Search ..... 166/302; 299/2, 7, 8, 299/14, 11; 208/8 R, 11 R; 423/119, 421; 209/128, 131; 204/168, 172; 196/98, 121; 201/19; 13/2 P; 219/121 P; 315/111.2–111.7

[56] References Cited

U.S. PATENT DOCUMENTS

| | | | |
|---|---|---|---|
| 1,269,747 | 6/1918 | Rogers | 299/2 |
| 1,872,591 | 8/1932 | Homan | 209/128 |
| 1,919,636 | 7/1933 | Karrick | 299/2 |
| 3,034,773 | 5/1962 | Legatski | 299/2 |
| 3,227,642 | 1/1966 | Lemelson | 204/172 X |
| 3,483,115 | 12/1969 | Haddad et al. | 208/11 R |
| 3,488,401 | 1/1970 | Ames | 204/172 X |
| 4,067,390 | 1/1978 | Camacho et al. | 166/302 |
| 4,118,282 | 10/1978 | Wallace | 208/8 R X |
| 4,131,416 | 12/1978 | Watson et al. | 299/11 X |
| 4,177,064 | 12/1979 | Wanzenberg et al. | 208/11 R X |
| 4,181,504 | 1/1980 | Camacho | 13/2 P X |
| 4,215,232 | 7/1980 | Tylko | 13/2 P |

FOREIGN PATENT DOCUMENTS

| | | | |
|---|---|---|---|
| 239972 | 3/1960 | Australia | 204/172 |

*Primary Examiner*—Stephen J. Novosad
*Assistant Examiner*—George A. Suchfield
*Attorney, Agent, or Firm*—Fulwider, Patton, Rieber, Lee & Utecht

[57] ABSTRACT

A process for separating hydrocarbons from naturally occurring mixtures comprising minerals and inorganic materials originating from rock admixed with oil, for example tar sands and oil shales. The process comprises introducing particles of such mixtures into a gaseous plasma of a chemically inert gas to vaporize the hydrocarbons and thus separate them from the solid particles. The solid particles are allowed to drop from the plasma. The vaporized oil is condensed as a separate stock.

14 Claims, 1 Drawing Figure

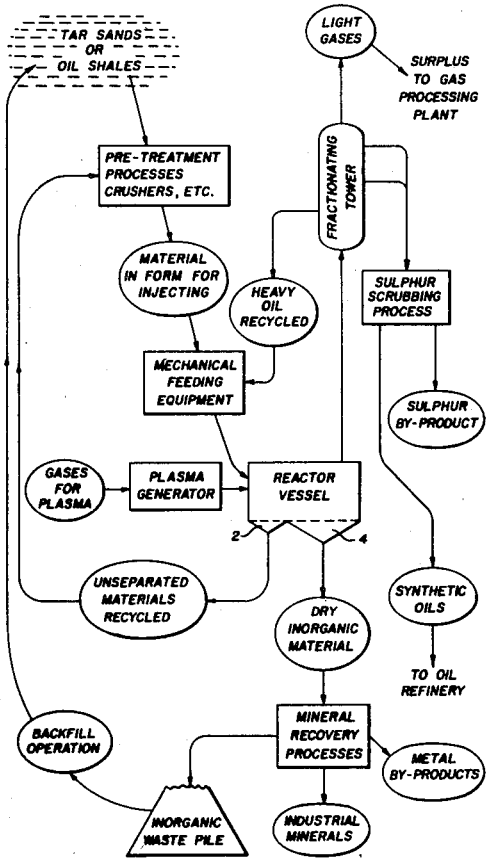

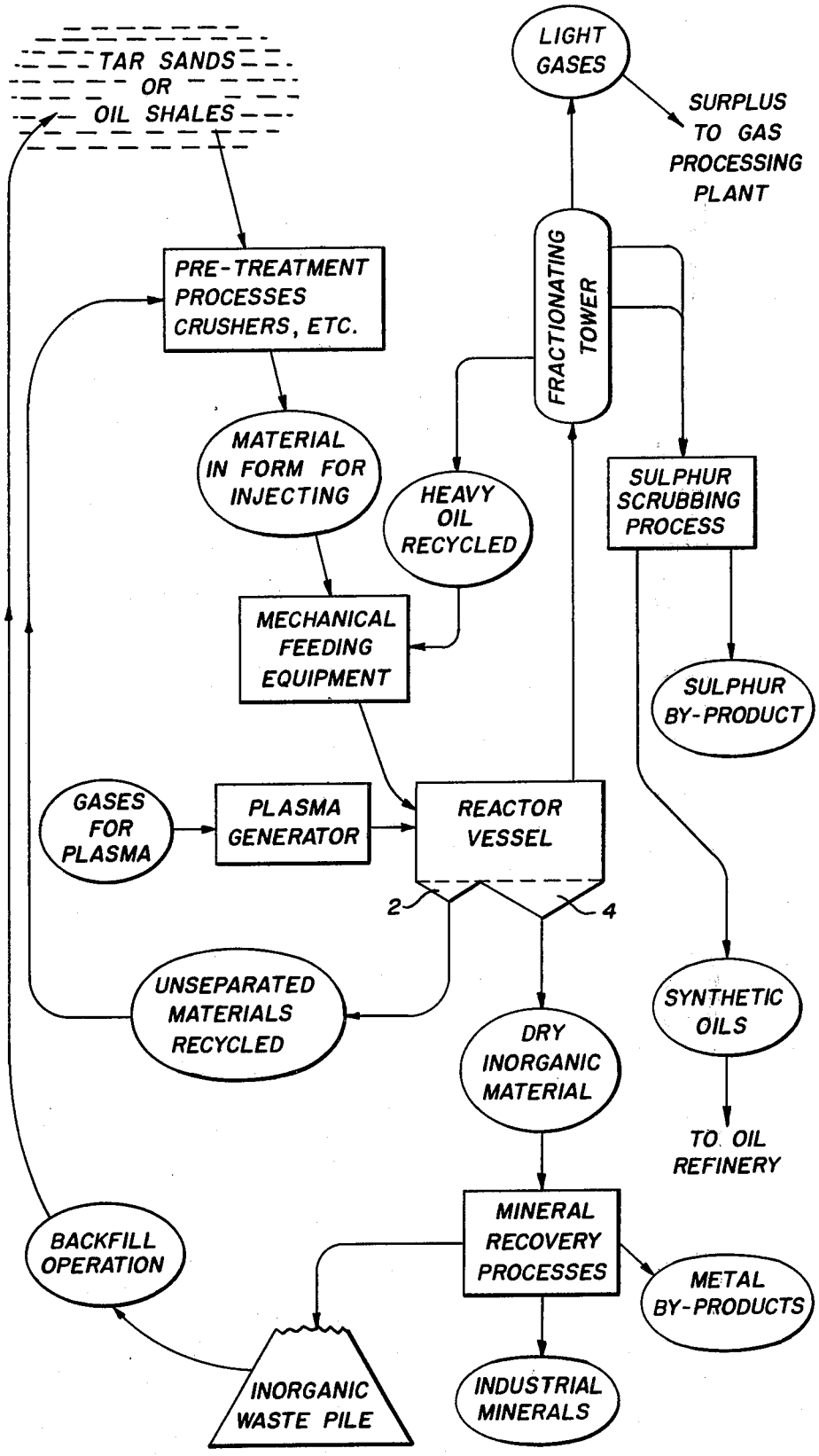
TAR SANDS
OR
OIL SHALES
LIGHT GASES
SURPLUS TO GAS PROCESSING PLANT
PRE-TREATMENT PROCESSES CRUSHERS, ETC.
FRACTIONATING TOWER
MATERIAL IN FORM FOR INJECTING
HEAVY OIL RECYCLED
SULPHUR SCRUBBING PROCESS
MECHANICAL FEEDING EQUIPMENT
SULPHUR BY-PRODUCT
GASES FOR PLASMA
PLASMA GENERATOR
REACTOR VESSEL
2
4
UNSEPARATED MATERIALS RECYCLED
DRY INORGANIC MATERIAL
SYNTHETIC OILS
TO OIL REFINERY
MINERAL RECOVERY PROCESSES
BACKFILL OPERATION
METAL BY-PRODUCTS
INORGANIC WASTE PILE
INDUSTRIAL MINERALS

PROCESS FOR SEPARATING OIL FROM A NATURALLY OCCURRING MIXTURE

FIELD OF THE INVENTION

This invention relates to a process for separating hydrocarbons from tar sands, oil shales and any other naturally occurring source of oil admixed with inorganic materials.

DESCRIPTION OF THE PRIOR ART

Tar sands and oil shales occupy a substantial area of North America particularly in Alberta and Colorado. Generally, tar sands are a mixture of bitumen or heavy crude oil with sand, water, clay, fine silt and small particles of various metallic compounds. The tar sands have the consistency of peanut butter with a viscosity of approximately 250 centistokes. The oil or bitumen part has a high carbon content in the range of 4 to 5.5% by weight and there are small amounts, for example 300 to 500 parts per million, of various metals such as nickel, vanadium and iron. It is typically lower in hydrogen with the hydrogen to carbon ratio being lower than in regular crude oil. The heavy crude oil or bitumen part does not flow naturally and cannot be pumped. The tar sands and oil shales contain extremely large reserves of oil and a number of attempts have been made to extract the oil from them.

All the current processes are characterized by huge expense, generally for the extremely massive machinery required. The processes currently used excavate the tar sands or oil shales by digging machines in open pit mining operations and then transport them by belt conveyors to a plant.

In the case of tar sands, at the plant they are mixed with hot water, steam and sodium hydroxide in slowly rotating drums. The resulting slurry is discharged into flotation tanks of hot water where the bitumen separates and floats to the surface as a froth. It is then skimmed off. The sand, most of the clay and other solid wastes sink to the bottom. Oil distillate and similar solvents may be added to the bitumen froth which is then spun in a centrifuge to remove remaining water and clay. The residue is heated in coking retorts to drive off the hydrocarbon oils in a gaseous form into a fractionating tower. In those towers they are separated into light gases, naphtha, kerosene and gas oil streams. These streams are upgraded by treatment of hydrogen and scrubbed to remove the sulphur, the presence of which is undesirable in any crude oil.

A charred coke residue remains in the retort which is removed and used as the fuel for the process. The streams are blended into a low sulphur content synthetic crude oil and conveyed by pipe line to an oil refinery for further refining.

The existing methods are inefficient. Heating bitumen in a retort produces too much coke that could produce useful oils and gases. Although the coke is used to produce heat excessive quantities of the oil are lost in this method. Small amounts of metal compounds trapped in the bitumen adversely affect the catalysts in subsequent steps of refining process. Furthermore, to be economic the process must be conducted on a massive scale. Huge quantities of water are required and the effect on the environment is severe. The process contaminates most of the water used to such an extent that it cannot be returned to natural water courses and is stored in huge tailing ponds.

SUMMARY OF THE INVENTION

The present invention seeks to produce a process in which the massive apparatus of the prior art is not required and in which the percentage yield is higher.

Accordingly the present invention is a process for separating oil from naturally occurring mixtures of oil, minerals and inorganic materials originating from rock, for example, tar sands and oil shales, the process comprising introducing particles of the naturally occurring mixtures into a gaseous plasma of a chemically inert gas to vaporize the hydrocarbons and thus separate them from the solid materials, allowing the solids to drop from the plasma and condensing the vaporized oil as a separate stock.

Plasma is simply an ionized stream of gas and the generation of plasmas is well known.

BRIEF DESCRIPTION OF THE DRAWING

A typical process according to the present invention is illustrated in the attached drawing, which is a flow diagram illustrating the extraction of oil from tar sands or oil shales together with treatment of the byproducts.

DESCRIPTION OF THE PREFERRED EMBODIMENT

Referring to the drawing the tar sands or oil shales to be treated in the process of the present invention are mined in conventional manner, for example using the mechanical equipment previously used to excavate them. The pretreatment may be crushing to a fairly fine size, for example, if tar sands in a frozen state, able to pass through a five mesh screen. Alternatively the material to be treated can be crushed to a paste for injection into the plasma in the reactor vessel. The material may also be slurried usually by the simple addition of water and crushing until the inorganic particles are reduced to a suspendable size.

The tar sands or oil shales in a form for injecting are then fed by a variety of means to the reactor vessel. They may be carried in a chemically inert, carrier gas which would be injected into the plasma stream in the reactor vessel. If the feed material has been crushed to a paste it may be stored in a hopper until required and then forced by a mechanical feed apparatus into the plasma stream in the reactor vessel. The slurry can simply be injected through input nozzles which, typically, may be conventional nozzles modified to handle the slurry.

All the heat treatment of the tar sands or oil shales is carried out in the reactor vessel by contact with the plasma. The plasma in the process of the present invention is generated by known methods. Conventional equipment, known in the art, is used in the process for the generation of a plasma stream. An induction generator is preferred. The generator can range in size from 200 kilowatts to several megawatts, with the preferred size being one megawatt. Within the generator a sustained plasma stream is created which is projected outside the generator in the form of a large flame and into the reactor vessel. Typically the plasma will be of an inert gas to avoid oxidation of the hydrocarbons. Nitrogen is preferred but argon, helium, carbon dioxide, carbon monoxide and hydrogen are also useful. A reactor vessel is attached to the plasma generator. The plasma flame reaches approximately $\frac{1}{3}$ of the length of the reactor vessel which is sealed. The reactor vessel powered by an induction generator of one megawatt could, typically, have a diameter of approximately 5 feet and a length of approximately 20 feet. Such a reactor is capable of processing approximately 20,000 barrels of tar sands or oil shales material a day. It should be pointed out that the reactor size is limited only by the energy input available and by the rate of feed available. A number of generator reactor vessels may be used to increase the production rate.

In the reactor vessel the plasma electron temperature is typically in the range from 10,000° F. to 80,000° F. A one megawatt generator is capable of delivering 100,000 btu per pound of material thruput and velocities of over 15,000 feet per second. In the reactor vessel the atmosphere is carefully controlled. The hydrocarbons are protected from oxidation first by the use of the inert gas such as nitrogen as the plasma source and, secondly, because the reactor is kept sealed and under pressure to exclude atmospheric oxygen. The pressure is typically in the range from 2 psi to 100 psi although the preferred range is between 7 and 40 psi. Pressures higher than 100 psi are not desirable and increase the cost of the components. The reactor vessel should be equipped with pressure gauge safety controls so that the plasma flame may automatically be shut off and the reactor vessel purged with an inert gas, for example, nitrogen, if the pressure drops below 2 psi. This prevents the possibility of damage by explosion.

It should be noted from the drawing that the reactor vessel includes a first hopper 2 and a second hopper 4. The first hopper 2 receives tar sand or oil shale material not properly treated in the reactor vessel which, due to its greater density, falls quickly out of the plasma stream into the hopper 2. The material is removed automatically from the hopper 2 and recycled back to the pretreatment process.

The second hopper is used to gather the dry, inorganic particles from which the hydrocarbons have been stripped. These are also removed automatically as discussed below.

Upon injection into the plasma stream in the reactor vessel the hydrocarbons of the tar sands or oil shales immediately vaporize. The dwell time in the plasma stream is carefully calculated so that the vaporization is extremely rapid but there is no effect on the inorganic content of the tar sands or oil shales. The vaporous hydrocarbons flow from the reactor vessel into a fractionating tower where they are fractionated into oils; the remaining light gases are drawn off at the top. By controlling the dwell time energy is not wasted in the heating of the inorganic particles. In the process electrical efficiency approaches 80% and thermal efficiency exceeding 30% has been achieved.

Due to the short dwell time the small particles of inorganic material, for example the sand, clay, mineral compounds and other waste of solids, remain unaffected. When stripped of hydrocarbons they are projected further down the length of the reactor vessel by the velocity of the plasma stream and as indicated drop into the second hopper 4.

In the fractionating tower three streams are produced. Heavy crude, medium weight oils and light weight oils. The initial gases not condensed are drawn off at the top of the column. If required the medium and light weight oil streams are scrubbed to remove sulphur and then passed to an oil refinery.

Thus, in the process acccording to the invention, there is an almost complete separation of the hydrocarbons from the inorganic materials of the tar sands or oil shales followed by an almost complete recovery of the hydrocarbons.

The inorganic particles, which are in the form of fine dry particles, in hopper 4 are in ideal condition for further processing. For example where tar sands have a good mineral content of valuable metals such as, nickel, vanadium and iron or where oil shales have a good content of industrial minerals such as nahcolite and dawsonite, these may be recovered by known techniques, for example, magnetic and centrifugal separation.

The process according to the present invention is unique in the use of a plasma flame for oil extraction. The huge amount of heat rapidly available is ideal to flash off even the heaviest hydrocarbons available in tar sands or oil shales. Because inert gases are used the hydrocarbons are not chemically decomposed but merely rapidly vaporize and quickly transferred to the fractionating tower. In the case of tar sands the process does not require the huge quantities of water required by the prior art nor is it necessary to burn substantial proportions of the oil in the tar sands as a means of generating heat. It is believed that the cost of recovering hydrocarbons from tar sands and oil shales can be reduced by some 50% using the process on a properly organized commercial scale.

We claim:

1. A process for separating hydrocarbons from naturally occurring mixtures comprising minerals and inorganic materials originating from rock admixed with oil, the process comprising introducing particles of such mixtures into a gaseous plasma of a chemically inert gas in a sealed reactor vessel in which the plasma electron temperature is in the range 10,000° F. to 80,000° F. to vaporize the hydrocarbons and thus separate them from the solid particles, allowing the solid particles to drop from the plasma and condensing the vaporized oil as a separate stock, the sealed reactor vessel being equipped with pressure control whereby the plasma is shut off and the vessel purged with an inert gas immediately the pressure drops below two pounds per square inch.

2. A process as claimed in claim 1 in which the mixture is tar sand.

3. A process as claimed in claim 1 in which the mixture is oil shale.

4. A process as claimed in claim 1 carried out in a sealed vessel having a plasma inlet; a mineral or inorganic materials originating from rock mixture injector, means to remove the hydrocarbon vapors and the separated solid particles, and means to control pressure within the vessel above atmospheric.

5. A process as claimed in claim 4 in which the pressure above atmospheric is in the range of 2 to 100 pounds per square inch.

6. A process as claimed in claim 5 in which the pressure is in the range 7 to 40 pounds per square inch.

7. A process as claimed in claim 1 including introducing the vaporized hydrocarbons to a separating tower where fractionation can be carried out.

8. A process as claimed in claim 1 in which the chemically inert gas is selected from the group consisting of nitrogen, argon, helium, carbon dioxide, carbon monoxide and hydrogen.

9. A process as claimed in claim 1 in which the mineral or inorganic materials originating from rock mixture in a frozen particulate state is introduced into the plasma stream by means of a carrier gas.

10. A process as claimed in claim 1 in which the mineral or inorganic materials originating from rock mixture is introduced into the plasma as a paste by mechanical means.

11. A process as claimed in claim 1 in which the mineral or inorganic materials originating from rock mixture is introduced into the plasma suspended in a liquid.

12. A process as claimed in claim 1 including the additional step of treating the separated solids to extract metal and industrial mineral values.

13. A process as claimed in claim 12 in which the metal values are nickel, vanadium and iron.

14. A process as claimed in claim 12 in which the industrial minerals are nahcolite, dawsonite and silica.

* * * * *